US007328459B2

(12) United States Patent
Walsh et al.

(10) Patent No.: US 7,328,459 B2
(45) Date of Patent: Feb. 12, 2008

(54) FOOT-COVERING COMPONENT OF A STOCKING FOOT WADER INCLUDING GRAVEL GUARD AND METHOD FOR MANUFACTURING

(75) Inventors: Kenneth C. Walsh, Bozeman, MT (US); Mary Anthony, Bozeman, MT (US); Judy Johnson, Bozeman, MT (US); Matt Bentle, Belgrade, MT (US); Donna Vincent, Bozeman, MT (US); Dwayne Oliverson, Belgrade, MT (US)

(73) Assignee: Simms Fishing Products LLC, Bozeman, MT (US)

( * ) Notice: Subject to any disclaimer, the term of this patent is extended or adjusted under 35 U.S.C. 154(b) by 188 days.

(21) Appl. No.: 11/277,505

(22) Filed: Mar. 26, 2006

(65) Prior Publication Data

US 2006/0179548 A1 Aug. 17, 2006

Related U.S. Application Data

(62) Division of application No. 10/637,264, filed on Aug. 8, 2003, now Pat. No. 7,073,203.

(51) Int. Cl.
*A41D 13/05* (2006.01)

(52) U.S. Cl. ..... 2/23; 2/82

(58) Field of Classification Search ..... 2/22, 2/23, 82, 87, 919, 911, 908, DIG. 5; 36/2 R, 36/136

See application file for complete search history.

(56) References Cited

U.S. PATENT DOCUMENTS

| | | | | |
|---|---|---|---|---|
| 3,633,290 | A * | 1/1972 | Rubeling | 36/2 R |
| 4,858,342 | A * | 8/1989 | Nicholson et al. | 36/109 |
| 4,912,860 | A | 4/1990 | Keller | |
| 5,022,096 | A * | 6/1991 | Pacanowsky | 2/227 |
| 5,245,767 | A * | 9/1993 | Morin | 36/136 |
| RE34,662 | E | 7/1994 | Keller | |
| 5,867,828 | A * | 2/1999 | Shih | 2/82 |
| 5,901,374 | A * | 5/1999 | Foster | 2/82 |
| 5,966,842 | A | 10/1999 | Hart, Jr. | |
| 6,154,884 | A * | 12/2000 | Dehner | 2/69 |
| 6,317,893 | B1 * | 11/2001 | Walton | 2/227 |
| 6,745,401 | B1 * | 6/2004 | David | 2/82 |
| 6,961,964 | B2 * | 11/2005 | Blenkarn | 2/228 |
| 7,073,203 | B2 * | 7/2006 | Walsh et al. | 2/23 |

* cited by examiner

*Primary Examiner*—Danny Worrell

(57) ABSTRACT

Methods for easily manufacturing a foot-covering component of a stocking foot wader including an effective gravel guard, and a foot-covering component including a gravel guard manufactured by such methods are disclosed. Preferably, the gravel guard is connected to the exterior surface of the leg-covering member and below the interior connection between the foot-covering member and the leg-covering member to provide a substantially watertight connection between the foot-covering member and the leg-covering member.

4 Claims, 6 Drawing Sheets

FOOT-COVERING COMPONENT OF A STOCKING FOOT WADER INCLUDING GRAVEL GUARD AND METHOD FOR MANUFACTURING

CROSS-REFERENCE TO RELATED APPLICATION

This application is a divisional of U.S. patent application Ser. No. 10/637,264, filed on Aug. 8, 2003 now U.S. Pat. No. 7,073,203.

FIELD OF THE INVENTION

The present method relates generally to manufacturing a foot-covering component of a stocking foot wader including a gravel guard and particularly, but not by way of limitation, to such a method for quickly and easily manufacturing such a foot-covering component of a stocking foot wader, and a foot-covering component including a gravel guard manufactured by such method.

BACKGROUND OF THE INVENTION

Fishermen often wear waders when wading into streams and rivers. Typically, waders have either an attached boot or a stocking foot that fits into a boot. Waders can extend as high as the fisherman's hips, waist or chest, and the choice depends, of course, on the water depth the fisherman expects to encounter. Simms Fishing Products, Corporation is a leading manufacturer and supplier of both booted and stocking foot waders.

Booted waders offer the obvious advantage of not having to purchase or transport boots. However, a booted wader has some disadvantages. For example, the fisherman may want to wear a different type of boot depending on the type of river or streambed he expects to encounter.

Fishermen often use felt-soled boots when fishing in rivers or streams with slippery, algae-covered rocks or boulders because they provide greater traction on such slippery surfaces. In other situations, the fisherman may elect to wear a treaded-boot when fishing in a pebbled or muddy streambed. Thus, to be prepared for any fishing situation, the fisherman may have to purchase and carry more than one pair of booted waders having different boot soles to accommodate different streambeds.

In contrast to booted waders, stocking foot waders, which include hip waders, chest-high waders and waist-high waders, are commonly used when it is desirable to provide flexibility in selecting the type of boot the fisherman wants or needs for a particular situation. Thus, a fisherman may carry both a felt-soled boot and a treaded boot to be ready for any streambed condition. Stocking foot waders provide this flexibility in contrast to booted waders. However, stocking foot waders may present the fisherman with additional challenges.

When using a stocking foot wader in rushing water, such as that normally found in streams and rivers, it is desirable to provide a gravel guard that covers the opening between the wader and the boot to keep gravel and stones out of the boot. Gravel guards are often available as separate articles that are placed over the top end of the boot to cover the boot opening. Gravel guards also can be integrated with the wader.

However, the manufacture of an effective, integrated gravel guard can be a complicated process. Of course, the more complicated the process, the more expensive the wader to the consumer. Thus, there is a need for a foot-covering component of a stocking foot wader with an effective, integrated gravel guard that can be efficiently manufactured to prevent a dramatic increase in the cost of manufacturing the wader.

SUMMARY OF THE INVENTION

According to one embodiment, there is provided a method for manufacturing a foot-covering component of a stocking foot wader that includes a built-in-gravel guard. First, a gravel guard member is provided and connected to a leg-covering member with a stitch, preferably with a 0.25-inch seam allowance. The gravel guard member is preferably elastic. A foot-covering member is then connected to the leg-covering/gravel guard assembly using adhesive. The adhesive is applied in such a manner that it covers the stitch line connecting the gravel guard to the leg-covering member or wader leg. All of the connection seams can be taped by using a seam sealing machine and nylon tape. Upon completion, a stocking-foot wader assembly is constructed by the methods disclosed herein. Preferably, the leg-covering member or wader leg comprises a stretched polytetrafluoroethylene fabric like Gore-Tex® and the foot-covering member or stocking foot comprises Neoprene.

In another embodiment, there is provided a method for assembling the gravel guard member. First, a piece of gravel guard material is cut to size. The material is sewn at the ends to form a sleeve of gravel guard material. An appropriate length and width of elastic material is cut to match the size of the gravel guard material. The ends of the elastic material are sewn together to form an elastic band, and the band is sewn to the interior bottom end of the gravel guard sleeve. In a preferred embodiment, a zigzag stitch is used to sew the top and bottom ends of the elastic band to the gravel guard sleeve. A boot hook is attached to the bottom end of the gravel guard member. Preferable, the boot hook is double bar-tacked to the bottom of the gravel guard. A stretch woven material is a preferred gravel guard material.

In yet another embodiment, there is provided a method for connecting the stocking foot to the wader leg. First, the wader is turned inside out and pulled over a metal cone so the bottom end of the wader leg is flat and snug around the cone. Next, the stocking foot wader assembly is turned inside out and pulled over the top of the cone and over the bottom end of the wader leg. The top end and ankle portion of the stocking foot is rolled up to expose a section on the exterior of the stocking foot. Coats of adhesive are applied to the exposed sections on the interior of the wader leg and the exterior portion of the stocking foot. The adhesive is allowed to dry before rolling down and correctly aligning the stocking foot over the wader leg. Heat is applied to the section of the assembly containing the adhesive and the assembly is allowed to cool. After heating, the inside and outside connection seams between the stocking foot and wader leg are taped with nylon tape. Preferably, the stocking leg when adhered to the wader leg overlaps the wader leg material by about 2.5 inches.

The various embodiments described above are provided by way of illustration only and should not be construed to limit the invention. Those skilled in the art will readily recognize various modifications and changes that may be made to the present invention without following the example embodiments and applications illustrated and described herein, and without departing from the true spirit and scope of the present invention, which is set forth in the following claims.

BRIEF DESCRIPTION OF THE DRAWINGS

In the drawings, which are not necessarily drawn to scale, like numerals describe substantially similar components throughout the several views. Like numerals having different letter suffixes represent different instances of substantially similar components. The drawings illustrate generally, by way of example, but not by way of limitation, various embodiments discussed in the present document.

DETAILED DESCRIPTION OF THE INVENTION

In the following detailed description, reference is made to the accompanying drawings that form a part hereof, and in which are shown by way of illustration specific embodiments or examples. These embodiments may be combined, other embodiments may be utilized, and structural and logical changes may be made without departing from the spirit and scope of the present invention. The following detailed description is, therefore, not to be taken in a limiting sense, and the scope of the present invention is defined by the appended claims and their equivalents.

Stocking foot waders refer to a type of wader that is intended to be used with a separate, detachable boot. That is, an individual wearing a stocking foot wader has the option and flexibility of using various types of boots with the stocking foot wader.

Figure 1:
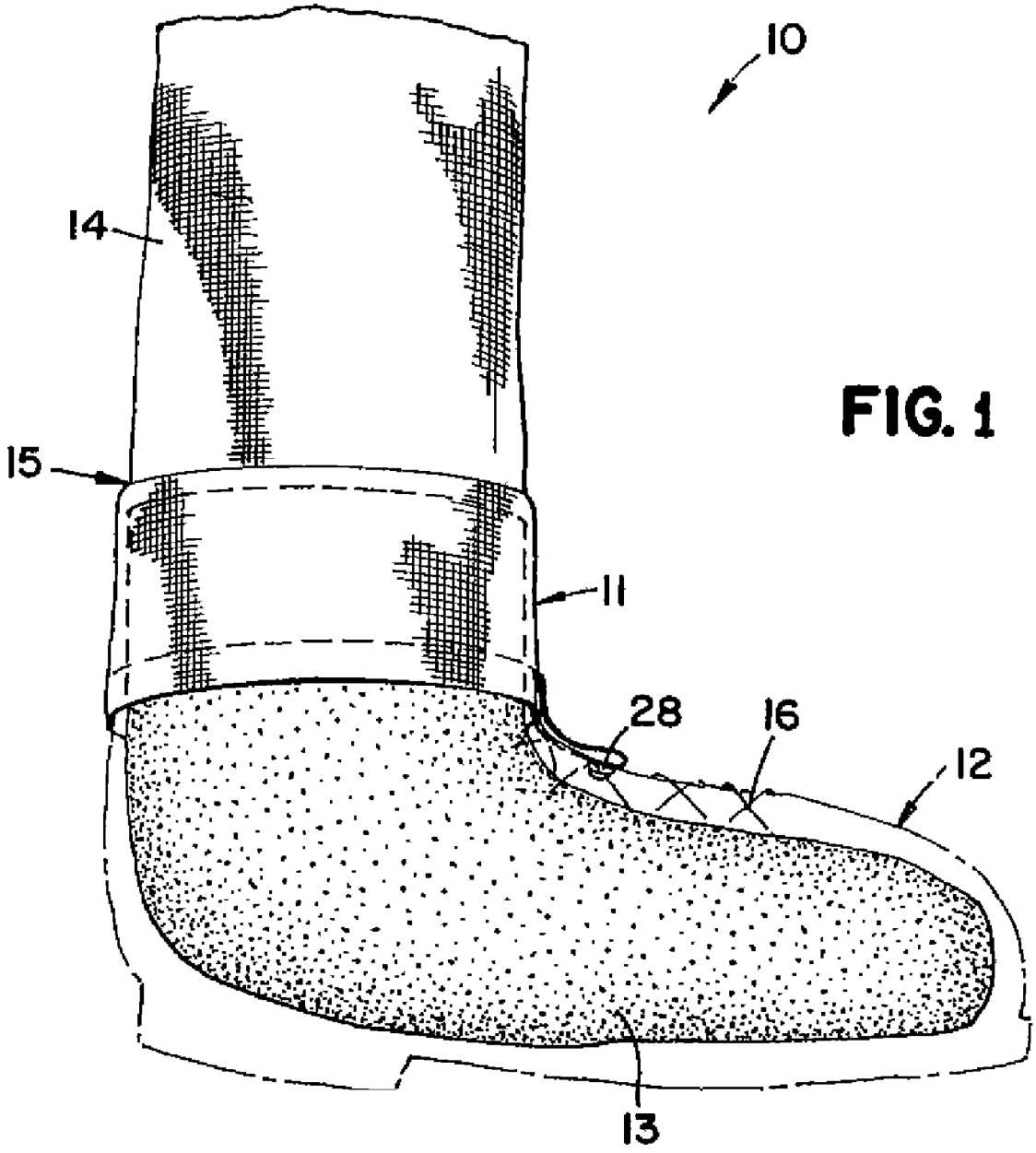
FIG. 1 is a side view, illustrating generally, among other things, an embodiment of a foot-covering component of a stocking foot wader including a gravel guard.

FIG. 1 is a side view, illustrating generally, among other things, an embodiment of a foot-covering component of a stocking foot water 10 including a gravel guard 11. The gravel guard 11 may comprise an elastic or stretch woven material and is shown as being rolled down over a boot 12. The foot-covering component of a stocking foot wader 10 includes a foot-covering stocking foot member 13, a leg-covering or wader leg member 14, and the gravel guard 11. The gravel guard 11 covers the opening 15 between the boot 12 and the wader leg 14.

Figure 2:
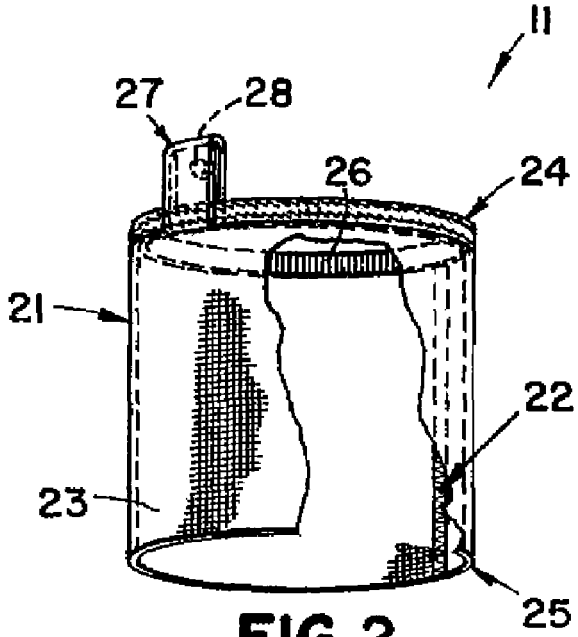
FIG. 2 is an assembly view, illustrating generally, among other things, and embodiment of a step in making a gravel guard for a foot-covering component of a stocking foot wader.

FIG. 2-6 generally illustrate the steps in making a foot-covering component of a stocking foot wader including a gravel guard. FIG. 2 is an assembly view, illustrating generally, among other things, an embodiment of a step in making the gravel guard. The gravel guard member 11 is formed by cutting a material 21 and sewing the material at the ends to create a seam 22. This forms a sleeve 23 having a bottom and 24 and a top end 25. The bottom 24 and top 25 ends are best understood from the perspective of when the gravel guard is rolled down over a boot. Thusly, bottom end 24 is adjacent the instep of the boot and top end 25 is adjacent the ankle of the boot. An elastic band 26 and a tab 27 can be sewn to the sleeve 23 and the bottom end 24. The tab 27 included a catch 28. This boot hook member comprising tab 27 and catch 28 is adapted to secure the gravel guard in the rolled down position. As shown in FIG. 1, the catch 28 engages the boot shoestrings 16 to hold the gravel guard member 11 in place over the boot opening 15.

Figure 3:
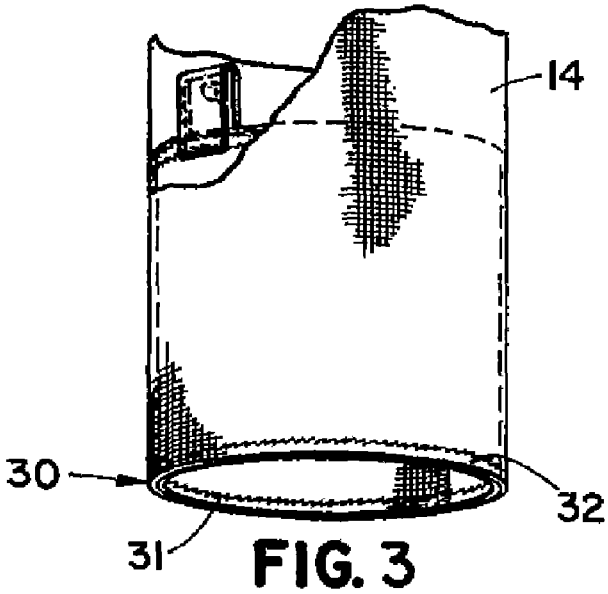
FIG. 3 is an assembly view, illustrating generally, among other things, an embodiment of a step in connecting the gravel guard to a wader leg.

FIG. 3 is an assembly view, illustrating generally, among other things, an embodiment of a step in connecting the gravel guard member 11 to the leg-covering member 14. The gravel guard member 11 is sewn to the leg-covering member 14 along the top end 25 of the gravel guard 11 and the termination or bottom end 30 of the leg-covering member 14 via a seam 31. The seam allowance 32 should be sufficient to maintain a desired connection between the gravel guard member 11 and the leg-covering member 14. The seam allowance 32 can be about 0.25 inch. To define the proper perspective for the reader, FIG. 3 shows the gravel guard member 11 and leg-covering member 14 turned inside out.

Figure 4:
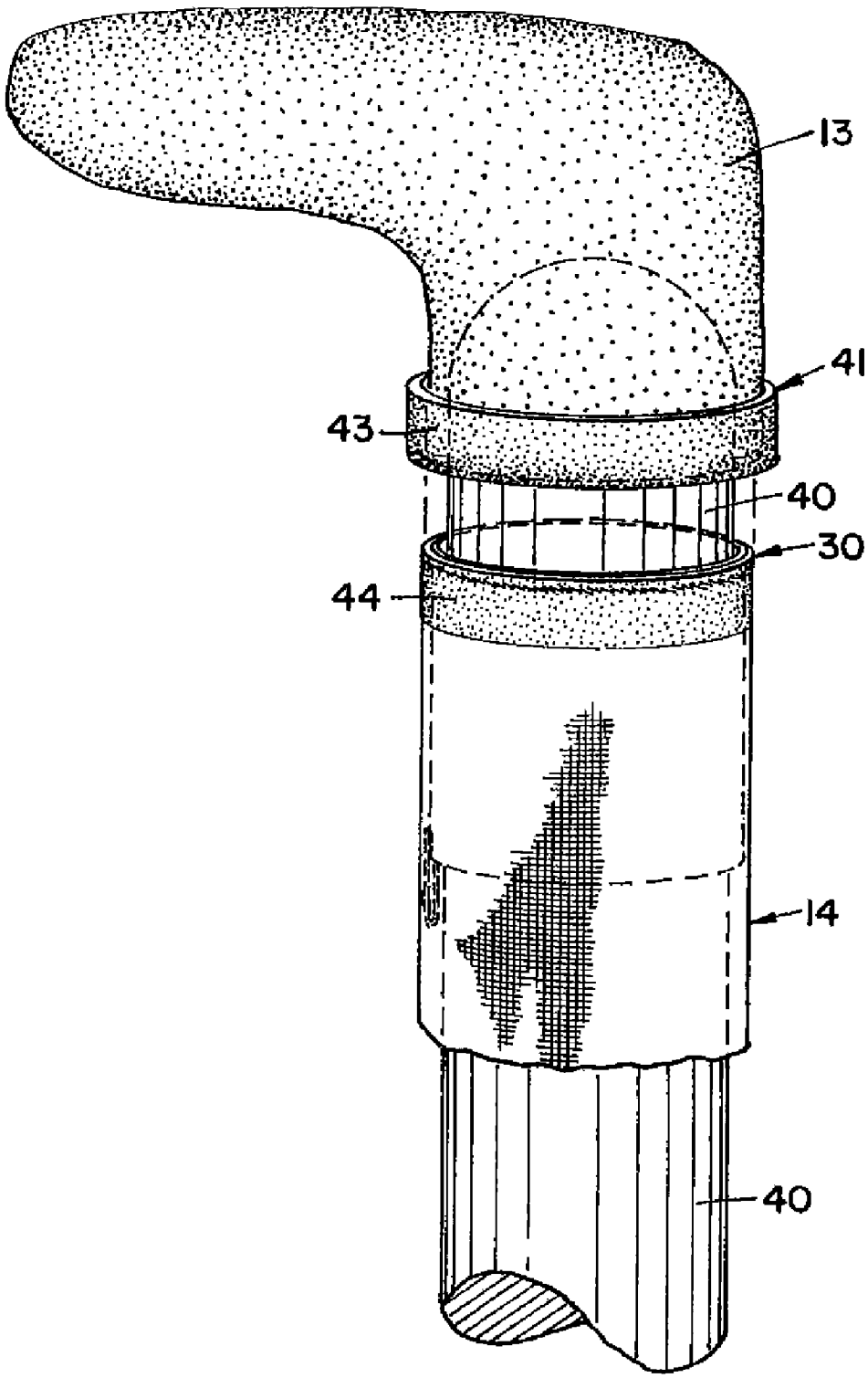
FIG. 4 is an assembly view, illustrating generally, among other things, an embodiment of a step in connecting a stocking foot to the wader leg/gravel guard assembly.

FIG. 4 is an assembly view, illustrating generally, among other things, an embodiment of a step in connecting the leg-covering member 14 and gravel guard member 11 to the foot-covering member 13. In this embodiment, the leg-covering member 14 and gravel guard member 11 are turned inside out and placed over a cone 40. The cone 40 takes up the slack in the leg-covering member 14 so that the wader leg 14 lies flat and snug around the cone 40. The cone 40 can comprise metal or any other material known in the art as suitable to practice the methods disclosed herein. The foot-covering member 13 is also turned inside out and pulled over the cone 40. The top end 41 of the foot-covering member 13 is placed over the bottom end 30 of the leg-covering member 14. In order to provide a desired level of connection between the foot-covering member 13 and the leg-covering member 14, the foot-covering member 13 and the leg-covering member 14 can overlap by about 2.5 inches. The top end 41 of the foot-covering member 13 can be rolled up to expose an adhesive coating area 43 on the ankle portion of the foot-covering member 13, and an adhesive coating area 44 adjacent the bottom end 30 of the leg-covering member 14. An adhesive can be applied to adhesive coating areas 43 and 44. Once the adhesive dries, the top end 41 of the foot-covering member 13 can be rolled over the bottom end 30 of the leg-covering member 14. The top end 41 of the foot-covering can be skived to form a smooth seam with the bottom end 30 of the leg-covering member 14. While the top end 41 need not be skived to satisfy the purpose of the invention, a skived top end is preferred. The word skived, as used and disclosed herein, means the top end 41 of the foot-covering 13 is shaved to a narrower thickness as compared to the thickness of the remaining foot-covering material to provide a flatter, more substantially watertight seam between the foot and leg-covering members. The foot-covering member 13 should be properly aligned with the leg-covering member 14 to ensure an ergonomic fit.

As further shown in FIGS. 3 and 4, the seam 31 connecting the gravel guard to bottom end 30 of the leg-covering member 14 is on the exterior surface of the leg-covering member 14 and below (closer to the foot) the interior seam 41 connecting the foot-covering member 13 to the leg-covering member 14. This prevents water from invading the leg-covering member through a gap or tear in the gravel guard seam and helps to ensure a substantially watertight connection between the stocking foot member and the leg-covering member.

Figure 5:
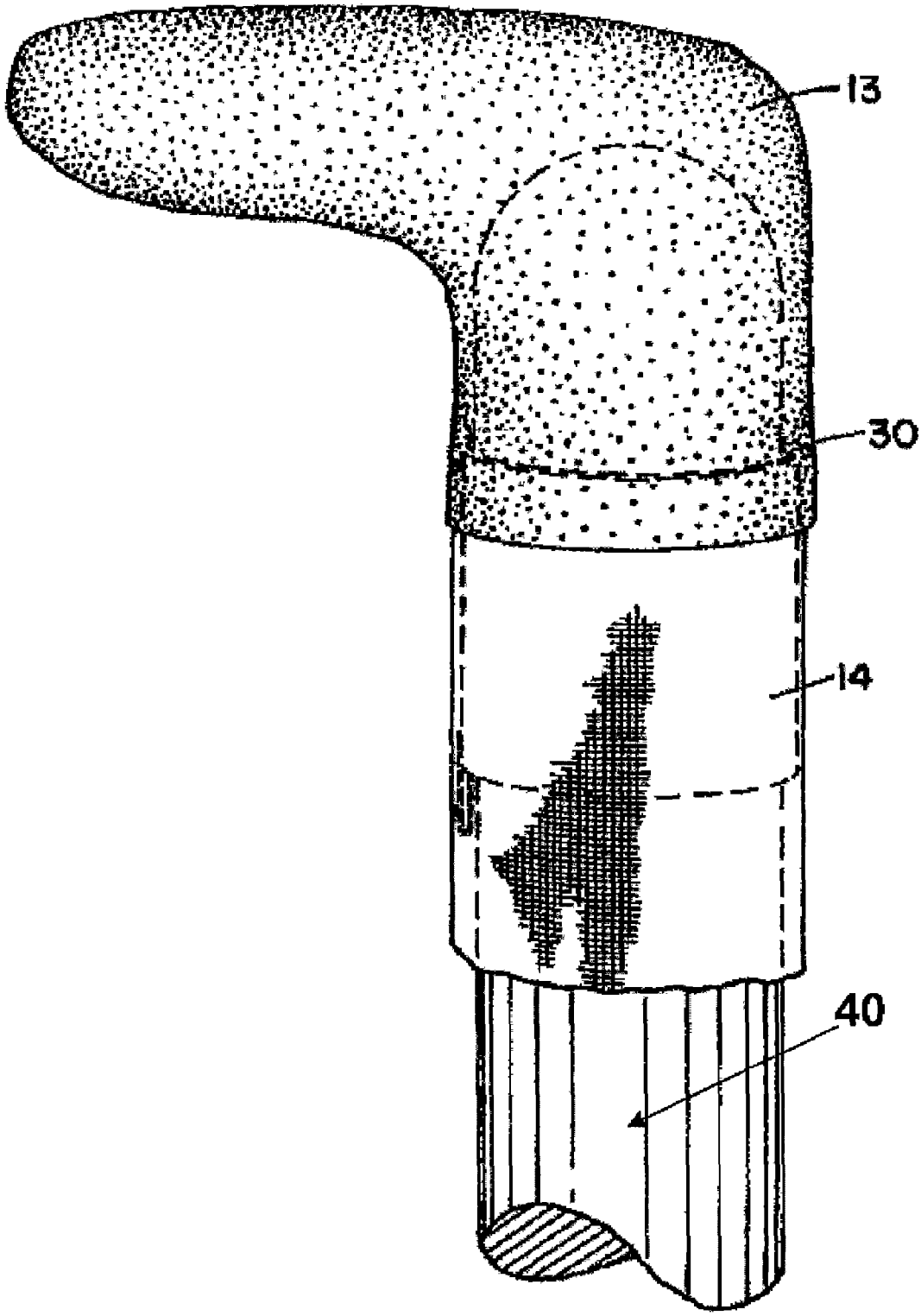
FIG. 5 is an assembly view, illustrating generally, among other things, an embodiment of another step in connecting a stocking foot to the wader leg/gravel guard assembly.

FIG. 5 is an assembly view, illustrating generally, among other things, an embodiment of a step in the production of a foot-covering component of a stocking foot wader after the adhesive has dried and the foot-covering member 13 has been rolled back down over the bottom end 30 of the leg-covering member 14. Thereafter, the wader can be removed from the cone 40 and turned right side out. Heat can then be used to activate the adhesive to provide bonding between the foot-covering member 13 and the leg-covering member 14.

Figure 6:
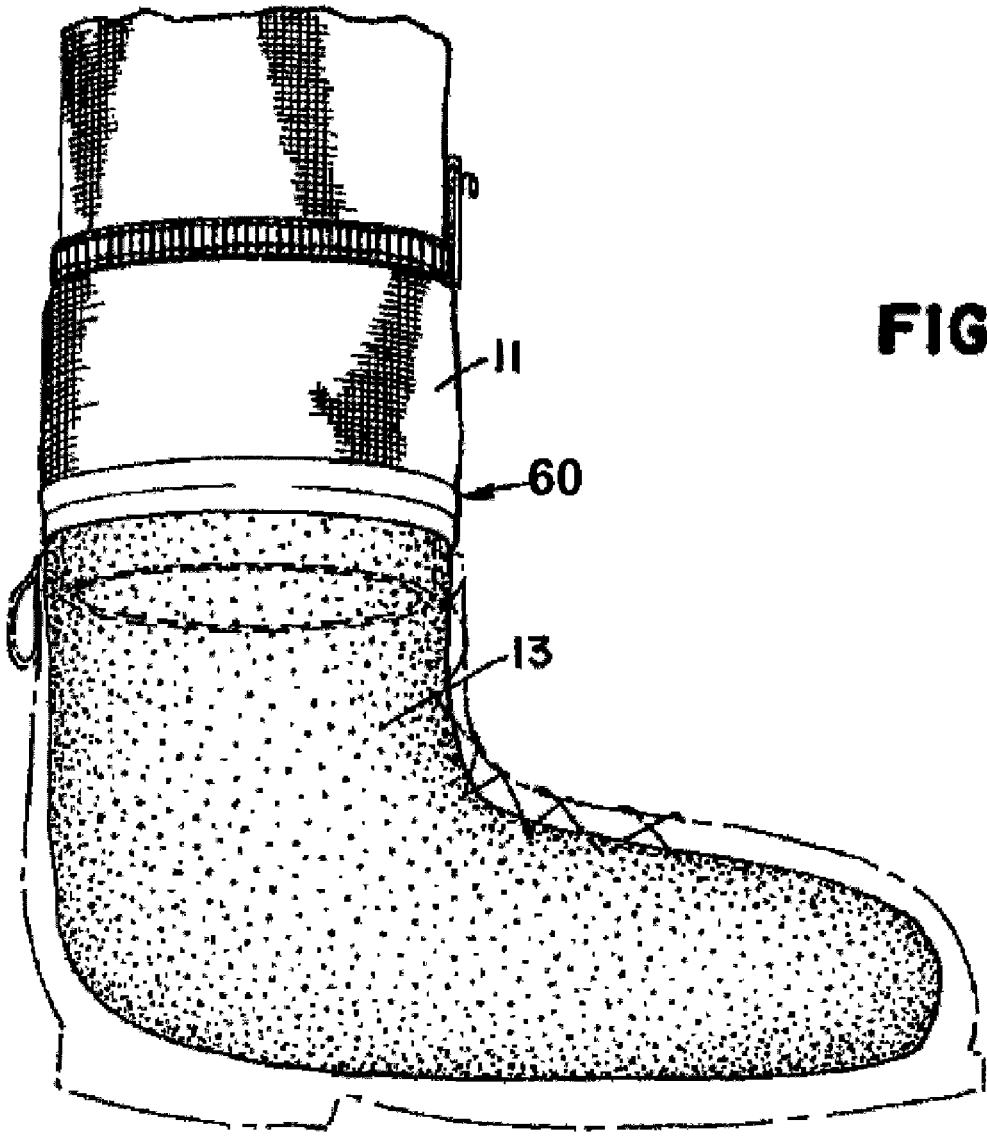
FIG. 6 is an assembly view, illustrating generally, among other things, an embodiment of a taping step in connecting a stocking foot to the wader leg/gravel guard assembly.

FIG. 6 is an assembly view, illustrating generally, among other things, an embodiment of a step in using sealing tape 60 to seal the outside seam allowance between the gravel guard member 11 and the foot-covering member 13.

Figure 7:
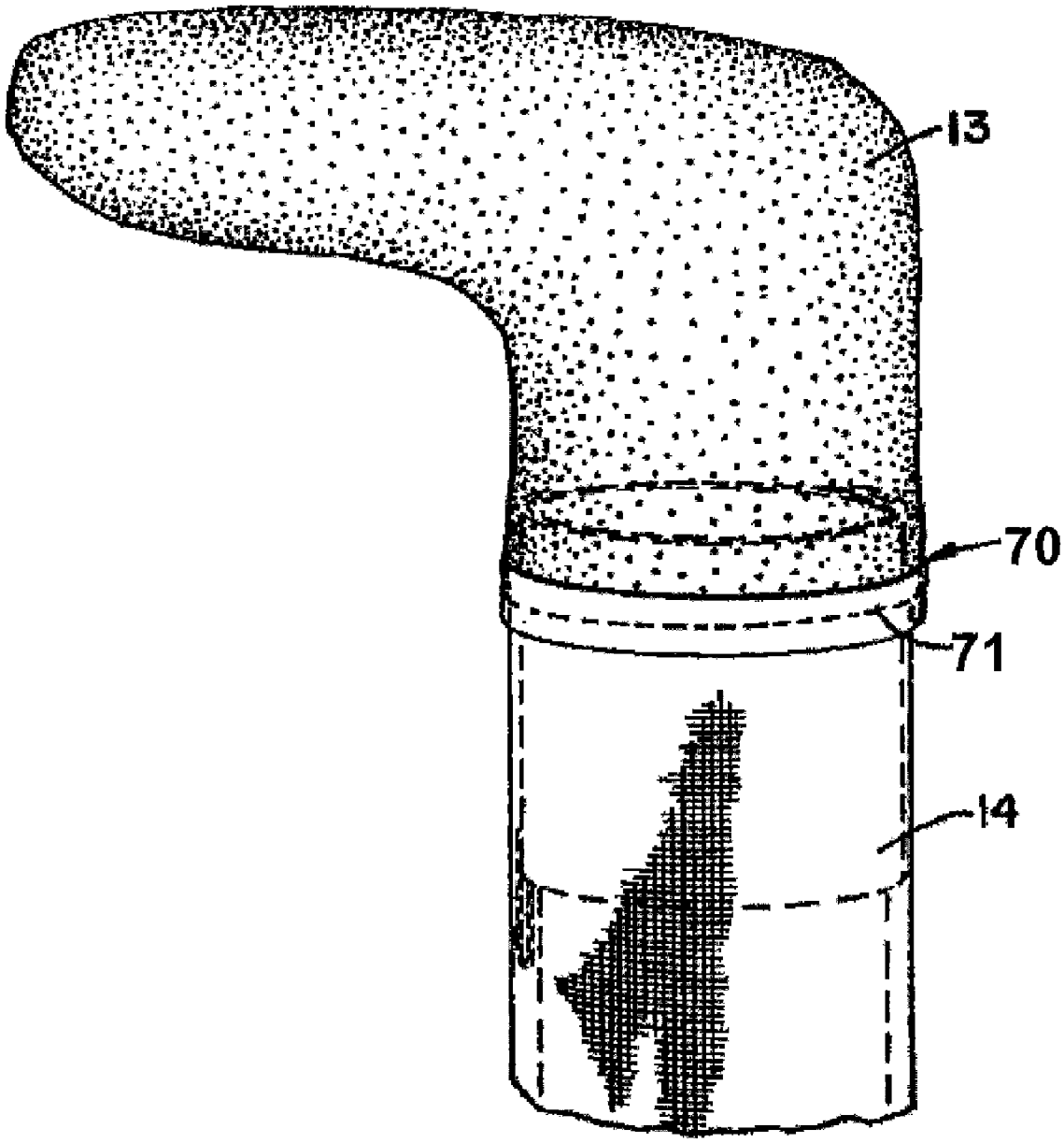
FIG. 7 is an assembly view, illustrating generally, among other things, an embodiment of a finishing taping step in the production of a foot-covering component of a stocking foot wader including a gravel guard.

FIG. 7 is an assembly view, illustrating generally, among other things, an embodiment of a step in using sealing tape 70 to seal the inside connection seam 71 between the top end 41 of the foot-covering member 13 and the leg-covering member 14. A seam-sealing machine can be used to apply the sealing tape 60 and 70, which can compromise nylon tape or other suitable tape.

It is to be understood that the above description is intended to be illustrative, and not restrictive. For example, the above-described embodiments may be used in combination with each other. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including," "includes" and "in which" are used as the plain-English equivalents of the respective terms "comprising," "comprises" and "wherein."

We claim:

1. A method for manufacturing a foot-covering component of a stocking foot wader including a gravel guard, the method comprising the steps of:

a. assembling a gravel guard member:

b. connecting the gravel guard member to a leg-covering member, said leg-covering member comprising an interior bottom end and an exterior bottom end; and c. connecting a foot-covering member to the leg-covering member; said foot-covering member comprising a top end and an interior ankle portion and an exterior ankle portion, wherein the step of connecting the foot-covering member to the leg-covering member further comprises the steps of:

a. turning the leg-covering member inside out;

b. pulling the inside out leg-covering member onto a metal cones so that the bottom end of the leg-covering member is flat and snug around the cone;

c. turning the foot-covering member inside out;

d. pulling the inside out foot-covering member over the top of the cone and over the bottom end of the inside out leg-covering member;

e. rolling up the top end of the inside out foot-covering member to expose a section on the exterior ankle portion of the foot-covering member;

f. applying a plurality of coats of adhesive to a section of the interior of the leg-covering member;

g. applying a plurality of coats of adhesive to the exposed section on the exterior ankle portion of the foot-covering member up to the top end;

h. allowing the plurality of coats of adhesive on the interior of the leg-covering member and the exterior ankle portion of the foot-covering member to dry;

i. rolling down the section of the foot-covering member that was coated with adhesive over the section of the leg-covering member that was coated with adhesive to form a stocking foot wader assembly;

j. aligning the foot-covering member for correct positioning;

k. removing the stocking foot wader assembly from the cone;

l. turning the stocking foot wader assembly right side out;

m. applying heat to the exterior of the foot-covering component of the stocking foot wader assembly at the sections containing the adhesive;

n. allowing the foot wader assembly to cool; and o. pulling the inside out foot-covering member over the cone and over the bottom end of the inside out leg-covering member so that the foot-covering member covers about 2.5 inches of the leg-covering member as measured from the bottom end of the leg-covering member.

2. A method for manufacturing a foot-covering component of a stocking foot wader including a gravel guard, the method comprising the steps of:

a. assembling a gravel guard member:

b. connecting the gravel guard member to a leg-covering member, said leg-covering member comprising an interior bottom end and an exterior bottom end; and c. connecting a foot-covering member to the leg-covering member; said foot-covering member comprising a top end and an interior ankle portion and an exterior ankle portion, wherein the step of connecting the foot-covering member to the leg-covering member further comprises the steps of:

a. turning the leg-covering member inside out;

b. pulling the inside out leg-covering member onto a metal cones so that the bottom end of the leg-covering member is flat and snug around the cone;

c. turning the foot-covering member inside out;

d. pulling the inside out foot-covering member over the top of the cone and over the bottom end of the inside out leg-covering member;

e. rolling up the top end of the inside out foot-covering member to expose a section on the exterior ankle portion of the foot-covering member;

f. applying a plurality of coats of adhesive to a section of the interior of the leg-covering member;

g. applying a plurality of coats of adhesive to the exposed section on the exterior ankle portion of the foot-covering member up to the top end;

h. allowing the plurality of coats of adhesive on the interior of the leg-covering member and the exterior ankle portion of the foot-covering member to dry;

i. rolling down the section of the foot-covering member that was coated with adhesive over the section of the leg-covering member that was coated with adhesive to form a stocking foot wader assembly;

j. aligning the foot-covering member for correct positioning;

k. removing the stocking foot wader assembly from the cone;

l. turning the stocking foot wader assembly right side out;

m. applying heat to the exterior of the foot-covering component of the stocking foot wader assembly at the sections containing the adhesive;

n. allowing the foot wader assembly to cool; and o. applying adhesive to cover a stitch line connecting the gravel guard member to the leg-covering member.

3. A method for manufacturing a foot-covering component of a stocking foot wader including a gravel guard, the method comprising the steps of:

a. assembling a gravel guard member:

b. connecting the gravel guard member to a leg-covering member, said leg-covering member comprising an interior bottom end and an exterior bottom end; and c. connecting a foot-covering member to the leg-covering member; said foot-covering member comprising a top end and an interior ankle portion and an exterior ankle portion, wherein the step of connecting the foot-covering member to the leg-covering member further comprises the steps of:

a. turning the leg-covering member inside out;

b. pulling the inside out leg-covering member onto a metal cones so that the bottom end of the leg-covering member is flat and snug around the cone;

c. turning the foot-covering member inside out;

d. pulling the inside out foot-covering member over the top of the cone and over the bottom end of the inside out leg-covering member;

e. rolling up the top end of the inside out foot-covering member to expose a section on the exterior ankle portion of the foot-covering member;

f. applying a plurality of coats of adhesive to a section of the interior of the leg-covering member;

g. applying a plurality of coats of adhesive to the exposed section on the exterior ankle portion of the foot-covering member up to the top end;

h. allowing the plurality of coats of adhesive on the interior of the leg-covering member and the exterior ankle portion of the foot-covering member to dry;

i. rolling down the section of the foot-covering member that was coated with adhesive over the section of the leg-covering member that was coated with adhesive to form a stocking foot wader assembly;

j. aligning the foot-covering member for correct positioning;

k. removing the stocking foot wader assembly from the cone;

l. turning the stocking foot wader assembly right side out;

m. applying heat to the exterior of the foot-covering component of the stocking foot wader assembly at the sections containing the adhesive;

n. allowing the foot wader assembly to cool; and o. applying two coats of adhesive to a section of the interior of the leg-covering member.

4. A method for manufacturing a foot-covering component of a stocking foot wader including a gravel guard, the method comprising the steps of:

a. assembling a gravel guard member:

b. connecting the gravel guard member to a leg-covering member, said leg-covering member comprising an interior bottom end and an exterior bottom end; and c. connecting a foot-covering member to the leg-covering member; said foot-covering member comprising a top end and an interior ankle portion and an exterior ankle portion, wherein the step of connecting the foot-covering member to the leg-covering member further comprises the steps of:

a. turning the leg-covering member inside out;

b. pulling the inside out leg-covering member onto a metal cones so that the bottom end of the leg-covering member is flat and snug around the cone;

c. turning the foot-covering member inside out;

d. pulling the inside out foot-covering member over the top of the cone and over the bottom end of the inside out leg-covering member;

e. rolling up the top end of the inside out foot-covering member to expose a section on the exterior ankle portion of the foot-covering member;

f. applying a plurality of coats of adhesive to a section of the interior of the leg-covering member;

g. applying a plurality of coats of adhesive to the exposed section on the exterior ankle portion of the foot-covering member up to the top end;

h. allowing the plurality of coats of adhesive on the interior of the leg-covering member and the exterior ankle portion of the foot-covering member to dry;

i. rolling down the section of the foot-covering member that was coated with adhesive over the section of the leg-covering member that was coated with adhesive to form a stocking foot wader assembly;

j. aligning the foot-covering member for correct positioning;

k. removing the stocking foot wader assembly from the cone;

l. turning the stocking foot wader assembly right side out;

m. applying heat to the exterior of the foot-covering component of the stocking foot wader assembly at the sections containing the adhesive;

n. allowing the foot wader assembly to cool; and o. applying two coats of adhesive to the exposed section on the exterior ankle portion of the foot-covering member up to the top end.

* * * * *